US005399478A

United States Patent [19]

Maskasky

[11] Patent Number: 5,399,478

[45] Date of Patent: Mar. 21, 1995

[54] CLASS OF GRAIN GROWTH MODIFIERS FOR THE PREPARATION OF HIGH CHLORIDE {111} TABULAR GRAIN EMULSIONS (I)

[75] Inventor: Joe E. Maskasky, Rochester, N.Y.

[73] Assignee: Eastman Kodak Company, Rochester, N.Y.

[21] Appl. No.: 281,500

[22] Filed: Jul. 27, 1994

[51] Int. Cl.[6] ..... G03C 1/07

[52] U.S. Cl. ..... 430/569; 430/600; 430/613

[58] Field of Search ..... 430/569, 600, 613

[56] References Cited

U.S. PATENT DOCUMENTS

| | | | |
|---|---|---|---|
| 4,400,463 | 8/1983 | Maskasky | 430/434 |
| 4,520,099 | 5/1985 | Akimura et al. | 430/613 |
| 4,713,323 | 12/1987 | Maskasky | 430/569 |
| 4,783,398 | 11/1988 | Takada et al. | 430/567 |
| 4,804,621 | 2/1989 | Maskasky | 430/567 |
| 4,952,491 | 8/1990 | Nishikawa et al. | 430/570 |
| 4,983,508 | 1/1991 | Ishiguro et al. | 430/569 |
| 5,178,997 | 1/1993 | Maskasky | 430/569 |
| 5,178,998 | 1/1993 | Maskasky et al. | 430/569 |
| 5,185,239 | 2/1993 | Maskasky | 430/569 |
| 5,298,387 | 3/1994 | Maskasky | 430/569 |
| 5,340,695 | 8/1994 | Yamaguchi | 430/613 |

*Primary Examiner*—Charles L. Bowers, Jr.
*Assistant Examiner*—Mark F. Huff
*Attorney, Agent, or Firm*—Carl O. Thomas

[57] ABSTRACT

A process is disclosed of preparing a high chloride {111} tabular grain emulsion. Tabular grains are formed having {111} major faces, containing at least 50 mole percent chloride and less than 5 mole percent iodide, based on silver, and accounting for at least 50 percent of total grain projected area by introducing silver ion into a gelatino-peptizer dispersing medium containing a stoichiometric excess of chloride ions with respect to silver ions and an iodo-substituted 8-hydroxyquinoline, which acts as a grain growth modifier.

11 Claims, No Drawings

CLASS OF GRAIN GROWTH MODIFIERS FOR THE PREPARATION OF HIGH CHLORIDE {111} TABULAR GRAIN EMULSIONS (I)

FIELD OF THE INVENTION

The invention relates to the precipitation of radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

These various photographic advantages were associated with achieving emulsions in which tabular grains having {111} major faces account for at least 50 percent of total grain projected area, hereinafter referred to as {111} tabular grain emulsions. Although the art has succeeded in preparing high chloride {111} tabular grain emulsions, the inclusion of high levels of chloride as opposed to bromide, alone or in combination with iodide, has been difficult. The basic reason is that tabular grains are produced by incorporating parallel twin planes in grains grown under conditions favoring {111} crystal faces. The most prominent feature of tabular grains are their parallel {111} major crystal faces.

To produce successfully a high chloride tabular grain emulsion two obstacles must be overcome. First, conditions must be found that incorporate parallel twin planes into the grains. Second, the strong propensity of silver chloride to produce {100} crystal faces must be overcome by finding conditions that favor the formation of {111} crystal faces.

Through extensive investigations organic compounds, hereinafter referred to as grain growth modifiers, have been identified that efficiently produce high chloride {111} tabular grain emulsions. Aromatic N-heterocyclic compounds capable of acting as grain growth modifiers include those disclosed by Maskasky U.S. Pat. No. 4,400,463 (e.g., adenine), Maskasky U.S. Pat. No. 4,713,323 (e.g., 4-aminopyrazolo[3,4-d]pyrimidine), Tufano et al U.S. Pat. No. 4,804,621 (e.g., 2,4-diamino-1,3,5-triazine), Maskasky U.S. Pat. No. 5,178,997 (e.g., 7-azaindole), Maskasky et al U.S. Pat. No. 5,178,998 (e.g., xanthine) and Maskasky U.S. Pat. No. 5,185,239 (e.g., 4,5,6-triaminopyrimidine). Dicationic bipyridinium salts capable of acting as grain growth modifiers include those described by Marimoto U.S. Pat. No. 4,983,508 (e.g., 1,1'-dibenzyl-4,4'-bipyridinium dichloride). Sulfur containing organic compounds capable of acting as grain growth modifiers include those described by Takada et al U.S. Pat. No. 4,783,398 (e.g., 2,4-thiazolidinedione) and Nishikawa et al U.S. Pat. No. 4,952,491 (e.g., 5-(3-ethyl-2(3)benzothiazolylidene)-3-β-sulfoethylrhodanine).

Maskasky U.S. Pat. No. 5,298,387 teaches to prepare a high chloride {111} tabular grain emulsion in the presence of an N-heterocyclic grain growth modifier, specifically a 2-hydroaminoazine. Thereafter the adsorbed 2-hydroaminoazine can be released from the tabular grain surfaces and replaced by a 5-iodobenzoxazolium compound. Although 5-iodobenzoxazolium compounds are capable of stabilizing high chloride {111} tabular grains once formed, these compounds cannot be relied upon as grain growth modifiers to produce high chloride {111} tabular grains in the course of emulsion precipitation.

Akimura et al U.S. Pat. No. 4,520,099 discloses halo and/or alkyl substituted 8-hydroxyquinolines to be useful antifoggants.

SUMMARY OF THE INVENTION

The present invention is based on the discovery of a new class of organic grain growth modifiers for use in the precipitation of high chloride {111} tabular grain emulsions.

In one preferred form the invention is directed to a process of preparing a high chloride {111} tabular grain emulsion, wherein tabular grains are formed having {111} major faces, containing at least 50 mole percent chloride and less than 5 mole percent iodide, based on silver, and accounting for at least 50 percent of total grain projected area, comprising introducing silver ion into a gelatino-peptizer dispersing medium containing a stoichiometric excess of chloride ions with respect to silver ions and a grain growth modifier, wherein the grain growth modifier is an iodo-substituted 8-hydroxyquinoline.

DESCRIPTION OF PREFERRED EMBODIMENTS

The present invention is directed to a process of preparing high chloride {111} tabular grain emulsions in the presence of a novel class of grain growth modifiers-specifically, 8-hydroxyquinolines containing at least one iodo substituent, herein referred to as iodo-substituted 8-hydroxyquinolines or iodo-8-hydroxyquinolines.

The required iodo substituent can occupy any synthetically convenient ring position of the 8-hydroxyquinolines. When the 8-hydroxyquinoline ring is not otherwise substituted, the most active sites for introduction of a single iodo substituent are the 5 and 7 ring positions, with the 7 ring position being the preferred substitution site. Thus, when the 8-hydroxyquinoline contains two iodo substituents, they are typically located at the 5 and 7 ring positions.

Further ring substitutions are not required, but can occur at any of the remaining ring positions. When the 5 and 7 ring positions have been previously substituted, iodo substitution can take place at other ring positions. Strongly electron withdrawing substituents, such as other halides, pseudohalides (e.g., cyano, thiocyanato, isocyanato, etc.), carboxy (including the free acid, its salt or an ester), sulfo (including the free acid, its salt or an ester), α-haloalkyl, and the like, enter into the same substitution reactions as iodo substituents, which are also strongly electron withdrawing. Substituents that are only mildly electron withdrawing or electron donating, such as alkyl, alkoxy, aryl and the like, are common at a variety of ring positions on both of the fused rings of the 8-hydroxyquinolines.

Polar substituents, such as the carboxy and sulfo groups, can perform the advantageous function of increasing the solubility of the iodo-substituted 8-hydroxyquinoline in the aqueous dispersing media employed for emulsion precipitation.

In one specifically preferred form the iodo-8-hydroxyquinolines satisfy the following formula:

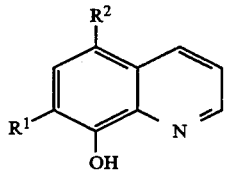

where $R^1$ and $R^2$ are chosen from among hydrogen, polar substituents, particularly carboxy and sulfo substituents, and strongly electron withdrawing substituents, particularly halo and pseudohalo substituents, with the proviso that at least one of $R^1$ and $R^2$ is iodo.

The following constitute specific illustrations of iodo-substituted 8-hydroxyquinoline grain growth modifiers contemplated for use in the practice of the invention:

| | |
|---|---|
| GGM-1 | 5-Chloro-8-hyroxy-7-iodoquinoline |
| GGM-2 | 8-Hydroxy-7-iodo-2-methylquinoline |
| GGM-3 | 4-Ethyl-8-hydroxy-7-iodoquinoline |
| GGM-4 | 5-Bromo-8-hydroxy-7-iodoquinoline |
| GGM-5 | 5,7-Diiodo-8-hydroxyquinoline |
| GGM-6 | 8-Hydroxy-7-iodo-5-quinolinesulfonic acid |
| GGM-7 | 8-Hydroxy-7-iodo-5-quinolinecarboxylic acid |
| GGM-8 | 8-Hydroxy-7-iodo-5-iodomethylquinoline |
| GGM-9 | 8-Hydroxy-7-iodo-5-trichloromethylquinoline |
| GGM-10 | α-(8-Hydroxy-7-iodoquinoline)acetic acid |
| GGM-11 | 7-Cyano-8-hydroxy-5-iodoquinoline |
| GGM-12 | 8-Hydroxy-7-iodo-5-isocyanatoquinoline |

An aqueous gelatino-peptizer dispersing medium is present during precipitation. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky U.S. Pat. No. 4,713,323 or King et al U.S. Pat. No. 4,942,120, here incorporated by reference.

During the precipitation of photographic silver halide emulsions there is always a stoichiometric excess of halide ion present. This avoids the possibility of excess silver ion being reduced to metallic silver and resulting in photographic fog. The teaching of Maskasky U.S. Pat. No. 4,713,323 to maintain a chloride concentration during precipitation of at least 0.5M can be applied to the process of the invention, but it is a significant advantage of this invention that the stoichiometric excess of chloride ion in the dispersing medium can be maintained at a level of less than 0.5M while still obtaining a high aspect ratio tabular grain emulsion. It is generally preferred that the chloride ion concentration in the dispersing medium be less than 0.4M and, optimally, equal to or less than 0.25M.

The advantages of limiting the stoichiometric excess of chloride ion present in the reaction vessel during precipitation include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent. It has also been observed that reduction in the chloride ion excess contributes to obtaining thinner tabular grains.

The grain growth modifiers of the invention are effective over a wide range of pH levels conventionally employed during the precipitation of silver halide emulsions. It is contemplated to maintain the dispersing medium within conventional pH ranges for silver halide precipitation, typically from 1.5 to 10, while the tabular grains are being formed, with a pH range of 2 to 7 being in most instances preferred. Within these pH ranges optimum performance of individual grain growth modifiers can be observed as a function of their specific structure. A strong mineral acid, such as nitric acid or sulfuric acid, or a strong mineral base, such as an alkali hydroxide, can be employed to adjust pH within a selected range. When a basic pH is to be maintained, it is preferred not to employ ammonium hydroxide, since it has the unwanted effect of acting as a ripening agent and is known to thicken tabular grains. However, it is possible to precipitate by the process of the invention high chloride {111} tabular grain emulsions in the presence of ammonium hydroxide or other conventional ripening agents (e.g., thioether or thiocyanate ripening agents) while limiting average tabular grain thicknesses to less than 0.3 μm.

Any convenient conventional approach of monitoring and maintaining replicable pH profiles during repeated precipitations can be employed (e.g., refer to Research Disclosure Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxy-methyl)aminomethane.

In forming high chloride {111} tabular grain emulsions, the emulsions are in one preferred form high aspect ratio tabular grain emulsions. That is, the high chloride {111} tabular grains accounting for at least 50 percent of total grain projected area and having a thickness of less than 0.3 μm exhibit an average aspect ratio of greater than 8. Aspect ratio is the ratio of tabular grain equivalent circular diameter (ECD) and thickness (t). In another preferred form the {111} tabular grain emulsions can be thin, intermediate aspect ratio emulsions. That is, the high chloride {111} tabular grains accounting for at least 50 percent of total grain projected area and having a thickness of less than 0.2 μm exhibit an average aspect ratio of from 5 to 8.

Generally photographic emulsions can exhibit average ECD's ranging up to 10 μm, although for most photographic applications average ECD's of less than 5 μm are preferred. The Examples demonstrate average grain thicknesses of substantially less than 0.2 μm. Since the precipitation process of the invention allows tabular grain growth with limited thickening of the tabular grains once formed, it is apparent that very high average aspect ratios well in excess of 100 are possible. For most photographic applications preferred average aspect ratios are in the range of from greater than 8 to 50.

The advantages of tabular grain emulsions stem not only from their average aspect ratios, but also from their relatively limited thicknesses. Therefore, another common definition of preferred tabular grain emulsions is in terms of their tabularity. Preferred emulsions prepared by the process of the invention exhibit high tabularity. A tabular grain emulsion exhibits high tabularity when $$ECD \div t^2 > 25$$

where ECD and t are both average values measured in micrometers (μm). This relationship can also be expressed as follows:

$$AR \div t > 25$$

where AR is average aspect ratio and t is average tabular grain thickness measured in μm.

It is, of course, preferred to maximize the proportion of total grain projected area accounted for by {111} tabular grains. It is generally preferred to obtain {111} tabular grain projected areas of at least 70 percent and optimally at least 90 percent of total grain projected area.

For tabular grains to satisfy the projected area requirement it is necessary first to induce twinning in the grains as they are being formed, since only grains having two or more parallel twin planes will assume a tabular form. Second, to realize favorably average aspect ratios or tabularities after twinning has occurred, it is necessary to restrain precipitation onto the major {111} crystal faces of the tabular grains, since this has the effect of thickening the grains. The iodo-substituted 8-hydroxyquinonline grain growth modifiers of this invention are effective during precipitation to facilitate tabular grain formation by twinning to satisfy tabular grain projected area requirements and to facilitate limited tabular grain growth to achieve preferred tabular grain thicknesses, average aspect ratios and tabularities.

Instead of employing only an iodo-substituted 8-hydroxyquinoline grain growth modifier of this invention to perform each of the twinning and tabular grain thickness control functions, it is possible to employ another, conventional growth modifier to perform one of these two functions or to supplement the iodo-substituted 8-hydroxyquinoline grain growth modifier in performing one or both of these functions.

It is specifically contemplated to employ in combination with the iodo-substituted 8-hydroxyquinoline grain growth modifiers of this invention an organic grain growth modifier chosen from among the aromatic N-heterocyclic grain growth modifiers disclosed by Maskasky U.S. Pat. No. 4,400,463,Maskasky U.S. Pat. No. 4,713,323, Tufano et al U.S. Pat. No. 4,804,621,Maskasky U.S. Pat. No. 5,178,997,Maskasky et al U.S. Pat. No. 5,178,998 and Maskasky U.S. Pat. No. 5,185,239; a dicationic bipyridinium salt, such as described by Marimoto U.S. Pat. No. 4,983,508; or a sulfur containing organic grain growth modifier of the type disclosed by Takada et al U.S. Pat. No. 4,783,398 and Nishikawa et al U.S. Pat. No. 4,952,491; the disclosures of each of these patents being here incorporated by reference.

It is generally recognized that introducing twin planes in the grains at a very early stage in their formation offers the capability of producing thinner tabular grains than can be achieved when twinning is delayed. For this reason it is usually preferred that the conditions within the dispersing medium prior to silver ion introduction at the outset of precipitation be chosen to favor twin plane formation. To facilitate twin plane formation it is contemplated to incorporate a grain growth modifier in the dispersing medium prior to silver ion addition. When one of the conventional organic grain growth modifiers are relied upon exclusively for twin plane formation, a conventional concentration level, taught in the patents cited above, can be employed. When the iodo-substituted 8-hydroxyquinoline is employed as the sole grain growth modifier during twin plane formation, useful concentrations are demonstrated in the Examples below. When the iodo-substituted 8-hydroxyquinoline and a conventional grain growth modifier are employed in concentration during twin plane formation, proportionate weightings of their concentrations can be undertaken.

The maximum concentration of many conventional grain growth modifiers in the dispersing medium is often limited by their solubilities. Fortunately, the iodo-substituted 8-hydroxyquinoline grain growth modifiers of this invention can contain solubilizing substituents that remove solubility as a factor in selecting maximum concentrations.

Another approach is to add the grain growth modifier as a solid dispersion. This has the advantage of providing a source capable of continuously releasing grain growth modifier into solution as grain surface area increases during precipitation.

Once a stable multiply twinned grain population has been formed within the dispersing medium, the primary, if not exclusive, function the grain growth modifier is called upon to perform is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of grain growth modifier required to control thickness growth of the tabular grain population is a function of the total grain surface area. By adsorption onto the {111} surfaces of the tabular grains the grain growth modifier restrains precipitation onto the grain faces and shifts further growth of the tabular grains to their edges.

The benefits of this invention can be realized using any amount of grain growth modifier that is effective to retard thickness growth of the tabular grains. It is generally contemplated to have present in the emulsion during tabular grain growth sufficient grain growth modifier to provide a monomolecular adsorbed layer over at least 25 percent, preferably at least 50 percent, of the total {111} grain surface area of the emulsion grains. Higher amounts of adsorbed grain growth modifier are, of course, feasible. Adsorbed grain growth modifier coverages of 80 percent of monomolecular layer coverage or even 100 percent are contemplated. In terms of tabular grain thickness control there is no significant advantage to be gained by increasing grain growth modifier coverages above these levels. Any excess grain growth modifier that remains unadsorbed is normally depleted in post-precipitation emulsion washing.

Prior to introducing silver salt into the dispersing medium at the outset of the precipitation process, no grains are present in the dispersing medium, and the initial grain growth modifier concentrations in the dispersing medium are therefore more than adequate to provide initially the monomolecular coverage levels noted above. As tabular grain growth progresses it is a simple matter to add grain growth modifier, as needed, to maintain monomolecular coverages at desired levels, based on knowledge of amount of silver ion added and the geometrical forms of the grains being grown. If grain growth modifier has been initially added in excess of its solubility limit, undissolved grain growth modifier can enter solution as additional dispersing medium is introduced during grain growth. This can reduce or even eliminate any need to add grain growth modifier to the reaction vessel as grain growth progresses.

Since silver bromide and silver iodide are markedly less soluble than silver chloride, it is appreciated that bromide and/or iodide ions, if introduced into the dispersing medium, are incorporated into the grains in preference to the chloride ions. The inclusion of bromide ions in even small amounts has been observed to improve the tabularities of the emulsions. Bromide ion concentrations of up to 50 mole percent, based on total silver are contemplated, but to increase the advantages of high chloride concentrations it is preferred to limit the presence of other halides so that chloride accounts for at least 80 mole percent, based on silver, of the completed emulsion. Iodide can be also incorporated into the grains as they are being formed in concentrations of up to 5 mole percent, based on silver, but it is preferred to limit iodide concentrations to 2 mole percent or less based on total silver. Thus, the process of the invention is capable of producing high chloride tabular grain emulsions in which the tabular grains consist essentially of silver chloride, silver bromochloride, silver iodochloride, silver iodobromochloride or silver bromoiodochloride, where the halides are designated in order of ascending concentrations.

Either single-jet or double-jet precipitation techniques can be employed in the practice of the invention, although the latter is preferred. Grain nucleation can occur before or instantaneously following the addition of silver ion to the dispersing medium. While sustained or periodic subsequent nucleation is possible, to avoid polydispersity and reduction of tabularity, once a stable grain population has been produced in the reaction vessel, it is preferred to precipitate additional silver halide onto the existing grain population.

In one approach silver ion is first introduced into the dispersing medium as an aqueous solution, such as a silver nitrate solution, resulting in instantaneous grain nuclei formation followed immediately by addition of the growth modifier to induce twinning and tabular grain growth. Another approach is to introduce silver ion into the dispersing medium as preformed seed grains, typically as a Lippmann emulsion having an average grain ECD of less than 0.05 μm. A small fraction of the Lippmann grains serve as deposition sites while the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012, Saito U.S. Pat. No. 4,301,241, Solberg et al U.S. Pat. No. 4,433,048 and Antoniades et al U.S. Pat. No. 5,250,403, the disclosures of which are here incorporated by reference. In still another approach, immediately following silver halide seed grain formation within or introduction into a reaction vessel, a separate step is provided to allow the initially formed grain nuclei to ripen. During the ripening step the proportion of untwinned grains can be reduced, thereby increasing the tabular grain content of the final emulsion. Also, the thickness and diameter dispersities of the final tabular grain population can be reduced by the ripening step. Ripening can be performed by stopping the flow of reactants while maintaining initial conditions within the reaction vessel or increasing the ripening rate by adjusting pH, the chloride ion concentration, and/or increasing the temperature of the dispersing medium. The pH, chloride ion concentration and grain growth modifier selections described above for precipitation can be first satisfied from the outset of silver ion precipitation or during the ripening step.

Except for the distinguishing features discussed above, precipitation according to the invention can take any convenient conventional form, such as disclosed in *Research Disclosure* Vol. 225, January 1983, Item 22534, and Vol. 308, December 1989, Item 308,119 (particularly Section I) and Maskasky U.S. Pat. Nos. 4,400,463 and 4,713,323, the disclosures of which are here incorporated by reference. It is typical practice to incorporate from about 20 to 80 percent of the total dispersing medium into the reaction vessel prior to nucleation. At the very outset of nucleation a peptizer is not essential, but it is usually most convenient and practical to place peptizer in the reaction vessel prior to nucleation. Peptizer concentrations of from about 0.2 to 10 (preferably 0.2 to 6) percent, based on the total weight of the contents of the reaction vessel are typical, with additional peptizer and other vehicles typically be added to emulsions after they are prepared to facilitate coating.

Once the nucleation and growth steps have been performed the emulsions can be applied to photographic applications following conventional practices. The emulsions can be used as formed or further modified or blended to satisfy particular photographic aims. It is possible, for example, to practice the process of this invention and then to continue grain growth under conditions that degrade the tabularity of the grains and/or alter their halide content. It is also common practice to blend emulsions once formed with emulsions having differing grain compositions, grain shapes and/or tabular grain thicknesses and/or aspect ratios.

EXAMPLES

The invention can be better appreciated by reference to the following examples.

Example 1.

AgBrCl (0.5 mole % Br) Tabular Grain Emulsion Made Using 6.0 mmole/Ag mole of GGM-6

To a stirred reaction vessel containing 400 mL of a solution at pH 6.0 and at 50° C. that was 1% in oxidized bone gelatin (<5 micromoles methionine per gram of gelatin), 0.040 molar in NaCl, 2.5 mmolar in NaBr, was added 0.42 g of GGM-6 mixed with 74 g water and then dissolved at 20° C. by adjusting the pH to 3.6 with NaOH solution. Then a 2M $AgNO_3$ solution and a 2.3M NaCl solution were added for 0.5 min. at 5.0 mL/min. The additions were stopped. The temperature was raised to 60° C. in 6 min. and then held at 60° C. for 10 min. Then the $AgNO_3$ solution was added at 0.40 mL/min. for 1 min., and thereafter its flow rate was linearly accelerated to 5.0 mL/min. during 30 min. and maintained at this rate until a total of 0.20 mole of silver had been added. The NaCl solution was added at a similar rate as needed to maintain a constant pCl of 1.41. The pH was maintained at 6.0±0.2 with a dilute NaOH solution.

The resulting high chloride {111} tabular grain emulsion contained a {111} tabular grain population with an average diameter of 3.5 μm, an average thickness of 0.13 μm, an aspect ratio of 27 and average tabularity of 208. The {111} tabular grains accounted for approximately 75% of total grain projected area.

EXAMPLE 2.

AgBrCl (10.5 mole % Br) Tabular Grain Emulsion Made Using 6.0 mmole/Ag mole of GGM-6

This example was prepared similarly to that of Example 1, except that the 2.3M NaCl solution was replaced by one 2.0M in NaCl and 0.20M in NaBr.

The resulting high chloride {111} tabular grain emulsion contained a {111} tabular grain population with an average diameter of 2.2 μm, an average thickness of 0.10 μm, an aspect ratio of 22 and an average tabularity of 220. The {111} tabular grains accounted for approximately 80% of total grain projected area.

Example 3.

AgBrCl (0.5 mole % Br) Tabular Grain Emulsion Made Using 3.0 mmole/Ag mole of GGM-5

To a stirred reaction vessel containing 400 mL of a solution at pH 6.0 and at 60° C. that was 1% in oxidized bone gelatin, 0.125M in NaCl, and 2.5 mM in NaBr, was added 0.24 g of GGM-5 dissolved in 10 mL of dimethylformamide as the grain growth modifier. Then a 2M $AgNO_3$ solution and a 2.3M NaCl solution were added for 0.5 min. at 5.0 mL/min. Then the additions were stopped, and the temperature was increased to 75° C. at a rate of 5° C. per 3 min. After 10 min. at 75° C., the $AgNO_3$ solution addition was started at 0.40 mL/min. for 1 min., then its flow rate was linearly accelerated to 5.0 mL/min. during 30 min. and maintained at this rate until a total of 0.20 mole of silver had been added. The NaCl solution was added at a similar rate as needed to maintain a constant pCl of 0.90. The pH was maintained at 6.0±0.2 with a dilute NaOH solution.

The resulting high chloride {111} tabular grain emulsion contained a {111} tabular grain population with an average diameter of 4.0 μm, an average thickness of 0.12 μm, an aspect ratio of 33 and an average tabularity of 275. The {111} tabular grains accounted for approximately 90% of total grain projected area.

Example 4.

AgCl Tabular Grain Emulsion Made Using 3.0 mmole/Ag mole of GGM-5

This example was prepared similarly to that of Example 3, except that no NaBr was added to the reaction vessel.

The resulting high chloride {111} tabular grain emulsion contained a {111} tabular grain population with an average diameter of 2.5 μm, an average thickness of 0.16 μm, an aspect ratio of 16 and an average tabularity of 100. The {111} tabular grains accounted for approximately 80% of total grain projected area.

Example 5.

AgBrCl (0.5 mole % Br) Tabular Grain Emulsion Made Using 3.0 mmole/Ag mole of GGM-5

To a stirred reaction vessel containing 400 mL of a solution at pH 6.0 and at 60° C. that was 1% in oxidized bone gelatin, 0.128M in NaCl, and 2.5 mM in NaBr, was added 0.24 g of GGM-5 dissolved in 5 mL of dimethylformamide as the grain growth modifier. Then a 2M $AgNO_3$ solution and a 2.3M NaCl solution were added for 0.5 min. at 5.0 mL/min. The additions were stopped for 10 min. Then the $AgNO_3$ solution was added at 0.40 mL/min. for 1 min., and thereafter its flow rate was linearly accelerated to 5.0 mL/min. during 30 min. and maintained at this rate until a total of 0.20 mole of silver had been added. The NaCl solution was added at a similar rate as needed to maintain a constant pCl of 0.89. The pH was maintained at 6.0±0.2 with a dilute NaOH solution.

The resulting high chloride {111} tabular grain emulsion contained a tabular grain population with an average diameter of 1.5 μm, an average thickness of 0.17 μm, an aspect ratio of 8.8 and an average tabularity of 52. The {111} tabular grains accounted for approximately 60% of total grain projected area.

Example 6.

AgBrCl (0.67 mole % Br) Tabular Grain Emulsion Made Using 4.0 mmole/Ag mole of GGM-5 Added as a Solid Dispersion in Water.

This example was prepared similarly to that of Example 3, except that 10 g of a solid dispersion containing 4.0 mmole/Ag mole of GGM-5 was added in place of the dimethylformamide solution, and the precipitation was stopped after 0.15 mole of Ag had been added.

The dispersion was prepared by ball milling for 45 min. a mixture of 952 mg of GGM-5 in 40 g water containing 0.08 g saponin. The resulting dispersion consisted of rod shaped particles having an average length of 10 μm and an average diameter of 0.4 μm.

The resulting high chloride tabular grain emulsion contained a {111} tabular grain population with an average diameter of 2.0 μm, an average thickness of 0.14 μm, an average aspect ratio of 14 and an average tabularity of 100. The {111} tabular grains accounted for approximately 85% of total grain projected area.

Example 7.

AgBrCl (0.5 mole% Br) Tabular Grain Emulsion Made Using 1.5 mmole/Ag mole of GGM-1

This example was prepared similarly to that of Example 3, except that 0.092 g of GGM-1 dissolved in 2.5 mL of dimethylformamide was added to the kettle as the grain growth modifier instead of GGM-5.

The resulting high chloride {111} tabular grain emulsion contained a {111} tabular grain population with an average diameter of 3.2 μm, an average thickness of 0.21 μm, an aspect ratio of 15 and an average tabularity of 71. The {111} tabular grains accounted for approximately 65% of total grain projected area. Comparative Examples 8 and 9.

Emulsions were prepared similarly to the one described in Example 3, except that the solution of GGM-5 was replaced by a solution consisting of its 5,7-dibromo or its 5,7-dichloro analogue dissolved in 5 mL dimethyformamide. As in Example 3, the reaction vessel was adjusted to and maintained throughout the precipitation at a pH of 6.0. The results are presented in Table I.

TABLE I

| Emulsion | Compound Tested as Grain Growth Modifier (GGM.) | GGM Level (mmole/ Ag mole) | pH | Major Emulsion Grain Population |
|---|---|---|---|---|
| Example 3 | 5,7-diiodo-8-hydroxyquinoline | 3.0 | 6.0 | tabular |
| Cmp. Ex. 8 | 5,7-dibromo-8-hydroxyquinoline | 3.0 | 6.0 | cubic |
| Cmp. Ex. 9 | 5,7-dichloro-8-hydroxyquinoline | 3.0 | 6.0 | cubic |

Only the 5,7-diiodo-8-hydroxyquinoline (GGM-5) produced a high chloride {111} tabular grain emulsion. The failure of the Comparative Examples 8 and 9 is attributed to the absence of an iodo substituent. The 5,7-dichloro and 5,7-dibromo analogues did not produce {111} tabular grain emulsions, the majority of these grains exhibited {100} crystal faces, and the majority of the grains were cubic.

The invention has been described in detail with particular reference to preferred embodiments thereof, but it will be understood that variations and modifications can be effected within the spirit and scope of the invention.

What is claimed is:

1. A process of preparing a high chloride {111} tabular grain emulsion, wherein tabular grains are formed having {111} major faces, containing at least 50 mole percent chloride and less than 5 mole percent iodide, based on silver, and accounting for at least 50 percent of total grain projected area, comprising introducing silver ion into a gelatino-peptizer dispersing medium containing a stoichiometric excess of chloride ions with respect to silver ions and a grain growth modifier, wherein the grain growth modifier is an iodo-substituted 8-hydroxyquinoline.

2. A process of preparing a high chloride {111} tabular grain emulsion according to claim 1 wherein the tabular grains with {111} major faces exhibit an average tabularity of greater than 25 and account for at least 70 percent of total grain projected area.

3. A process of preparing a high chloride {111} tabular grain emulsion according to claim 1 wherein the {111} tabular grains contain at least 80 mole percent chloride and up to 2 mole percent iodide, with any remaining halide being bromide.

4. A process of preparing a high chloride {111} tabular grain emulsion according to claim 1 wherein 8-hydroxyquinoline contains a 7-iodo substituent.

5. A process of preparing a high chloride {111} tabular grain emulsion according to claim 1 wherein the grain growth modifier is added as a solid dispersion.

6. A process of preparing a high chloride {111} tabular grain emulsion according to claim 1 wherein the 8-hydroxyquinoline contains a solubility enhancing substituent.

7. A process of preparing a high chloride {111} tabular grain emulsion according to claim 1 wherein the 8-hydroxyquinoline satisfies the formula:

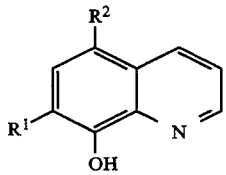

where $R^1$ and $R^2$ are chosen from among polar and halo substituents, with the proviso that at least one of $R^1$ and $R^2$ is iodo.

8. A process of preparing a high chloride {111} tabular grain emulsion according to claim 7 wherein the polar substituent is a carboxy or sulfo substituent.

9. A process of preparing a high chloride {111} tabular grain emulsion according to claim 7 wherein each of $R^1$ and $R^2$ are halo substituents.

10. A process of preparing a high chloride {111} tabular grain emulsion according to claim 7 wherein one of $R^1$ and $R^2$ is an iodo substituent and the remaining of $R^1$ and $R^2$ is a sulfo substituent.

11. A process of preparing a high chloride {111} tabular grain emulsion according to claim 1 wherein the iodo-substituted 8-hydroxyquinoline is 5-chloro-7-iodo-8-hydroxyquinoline, 5-bromo-7-iodo-8-hydroxyquinoline or 8-hydroxy-7-iodo-5-quinoline sulfonic acid.

* * * * *